US008536971B1

(12) United States Patent
Waseem et al.

(10) Patent No.: US 8,536,971 B1
(45) Date of Patent: Sep. 17, 2013

(54) MAGNETIC COMPONENT

(76) Inventors: Saher Waseem, Hilliard, OH (US); Sana Waseem, Hilliard, OH (US); Waseem Ahmed Roshen, Hilliard, OH (US)

( * ) Notice: Subject to any disclaimer, the term of this patent is extended or adjusted under 35 U.S.C. 154(b) by 0 days.

(21) Appl. No.: 13/452,677

(22) Filed: Apr. 20, 2012

(51) Int. Cl.
*H01F 27/24* (2006.01)
*H01F 17/04* (2006.01)

(52) U.S. Cl.
USPC ..... 336/212; 336/214; 336/221

(58) Field of Classification Search
USPC ..... 336/212, 214, 215, 216, 221
See application file for complete search history.

(56) References Cited

U.S. PATENT DOCUMENTS 518,188 A * 4/1894 Hirai et al. ..... 200/528
3,335,383 A * 8/1967 Jorden ..... 338/32 R
4,308,495 A * 12/1981 Yasumura ..... 323/250
5,084,958 A * 2/1992 Yerman et al. ..... 29/606
5,414,401 A * 5/1995 Roshen et al. ..... 336/178
6,927,667 B1 * 8/2005 Busletta et al. ..... 336/208
7,136,293 B2 * 11/2006 Petkov et al. ..... 363/126
7,332,992 B2 * 2/2008 Iwai ..... 336/170
7,375,607 B2 * 5/2008 Lee et al. ..... 336/178
2010/0321958 A1 * 12/2010 Brinlee et al. ..... 363/21.1

* cited by examiner

*Primary Examiner* — Mohamad Musleh
*Assistant Examiner* — Joselito Baisa
(74) *Attorney, Agent, or Firm* — Dale F. Regelman; Quarles & Brady LLP

(57) ABSTRACT

A magnetic component includes a magnetic component core. The magnetic component core includes a first plate, a second plate, a secondary core post connected between the first plate and the second plate, and a plurality of primary core posts disposed between the first plate and the second plate. Each of the plurality of primary core posts including a first section connected to the first plate and a second section connected to the second plate. The first and second section of each of the plurality of primary core posts is separated by a gap. A secondary winding is formed about the secondary core post. Primary windings are formed about each of the plurality of primary core posts.

20 Claims, 14 Drawing Sheets

MAGNETIC COMPONENT

FIELD OF THE INVENTION

This invention relates to a magnetic component of an electrical circuit that provides efficient coupling between multiple primary inductor windings and a secondary inductor winding, while minimizing coupling between each of the multiple primary inductor windings. In certain embodiments, the invention is directed to an apparatus and method for providing a magnetic component that may be incorporated into an electrical circuit arranged to extract power from a power source having a relatively high internal impedance.

BACKGROUND OF THE INVENTION

Many electrical power sources exist that have high internal resistances. The internal resistance of a power source measures the resistance within that power source to the flow of current through the power source. Internal resistance can be dependent upon many factors, including the construction of the power source, ambient temperature conditions, and changes in the internal chemistry of the power source. Although internal resistance is often associated with a power source comprising batteries, other types of power sources can have relatively high internal resistance. Examples of such power sources include solar cells and fuel cells.

When a power source has a relatively high internal resistance, it is difficult to extract electrical energy from the source in an efficient manner because the power source's internal resistance dissipates a relatively large portion of the electrical energy. That dissipated energy is therefore consumed within the power source and is never delivered to the load. Additionally, it is difficult to use a power source with high internal resistance to provide a desired voltage to a given electrical load, such as a particular electrical or electronic circuit, because the voltage supplied by the power source drops substantially as the load draws current from the power source. If a number of high internal resistance power sources are connected in series (for example, to generate a high output voltage), there are additional losses in terms of extracted power because the current flowing through each power source must pass through the internal resistances of the other power sources that connect to it.

In a circuit arranged to extract energy from a high impedance power source, a number of magnetic components may be utilized to facilitate energy extraction. To ensure efficient operation, it is important that those magnetic components efficiently couple primary and secondary windings to minimize losses within the extraction circuit.

SUMMARY OF THE INVENTION

In one implementation, the present invention is a magnetic component including a core. The core includes a first plate, a second plate, a secondary core post connected between the first plate and the second plate, and a plurality of primary core posts disposed between the first plate and the second plate. Each of the plurality of primary core posts includes a first section connected to the first plate and a second section connected to the second plate. The first and second section of each of the plurality of primary core posts is separated by a gap. The magnetic component includes a secondary winding formed about the secondary core post, and primary windings formed about each of the plurality of primary core posts.

In another implementation, the present invention is a magnetic component core. The magnetic component core includes a first plate, a second plate, a secondary core post connected between the first plate and the second plate, and a plurality of primary core posts disposed between the first plate and the second plate. Each of the plurality of primary core posts includes a first section connected to the first plate and a second section connected to the second plate. The first and second section of each of the plurality of primary core posts is separated by a gap.

In another implementation, the present invention is a method of manufacturing a magnetic component. The method includes forming a first plate of a magnetic component core. The first plate includes a first primary core post and a first secondary core post formed over a surface of the first plate. A height of the first primary core post above the surface of the first plate is less than a height of the first secondary core post above the surface of the first plate. The method includes forming a second plate of the magnetic component core. The second plate includes a second primary core post and a second secondary core post formed over a surface of the second plate. A height of the second primary core post above the surface of the second plate is less than a height of the second secondary core post above the surface of the second plate. The method includes connecting the first and second plate of the magnetic component core by joining the first secondary core post to the second secondary core post.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Some of the functional units described in this specification have been labeled as modules in order to more particularly emphasize their implementation independence. For example, a module may be implemented in field programmable gate arrays, programmable array logic, programmable logic devices, or the like. Modules may also be implemented in software for execution by various types of processors.

Figure 9:
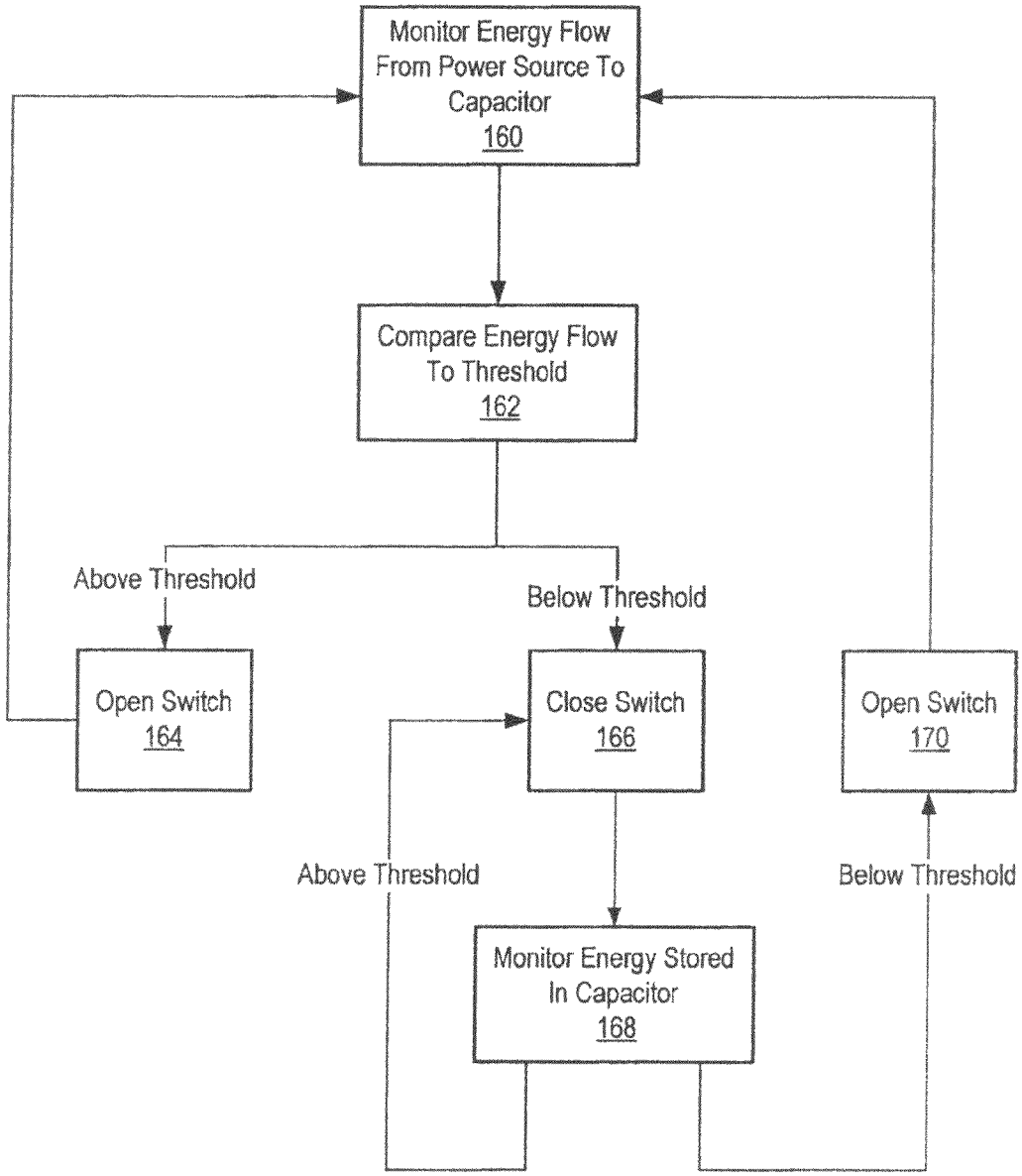
FIG. 9 is a flowchart illustrating an example method for extracting power from a power source.

The schematic flow chart diagrams included are generally set forth as logical flow-chart diagrams (e.g., FIG. 9). As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow-chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The invention will be described as embodied in an apparatus and method for a magnetic component of an electrical circuit that provides efficient coupling between multiple primary inductor windings and a secondary inductor winding, while minimizing coupling between each of the multiple primary inductor windings. In certain embodiments, the invention is directed to an apparatus and method for providing a magnetic component that may be incorporated into an electrical circuit arranged to extract power from a power source having a relatively high internal impedance.

In the present disclosure, the invention is described as being configured for incorporation into an electrical circuit arranged for extracting power from a power source, though a person of ordinary skill in the art would appreciate other uses for the magnetic component such as in applications calling for an efficient, multiple-winding transformer or applications calling for a device capable of transferring electrical energy from one circuit to another. As such, the present disclosure provides an example use of the present magnetic component, but other uses of the present magnetic component are conceivable. In certain embodiments, the invention is directed to a magnetic component for use in an electrical circuit for extracting power from a power source having a relatively high internal impedance. In one implementation, an enhancement factor of approximately 2 to 3.5 can be achieved using the present apparatus and method in such a circuit.

In one particular implementation, the present magnetic component is incorporated into an electrical circuit including a capacitor connected across the terminals of a high impedance power source. The capacitor is configured to operate as both a power extractor and a resonant component to transfer extracted power from the power source to an input of the magnetic component. The circuit is operated in a high frequency mode and power is transferred from the power source to the magnetic component in an efficient manner. The magnetic component is then used to deliver energy to an attached load.

In another implementation of the present system, the invention may be used in a circuit configured to reduce the internal power dissipation in solar cells (or other high internal resistance power sources) that are connected in series. The circuit is configured to provide an independent path for the current to flow from each power source to the extracting circuit. This implementation also facilitates obtaining a desired voltage from the series-connected power sources.

The present invention is a magnetic component for use in an electrical circuit. The magnetic component provides efficient coupling between multiple primary inductor windings and a secondary inductor winding formed about the magnetic component, while minimizing coupling between each of the multiple primary inductor windings. As described below, the magnetic component may be fabricated as a transformer having a core, a plurality of primary windings and a single secondary winding. The core posts of the primary windings incorporate air gaps, while the core of the secondary windings does not incorporate an air gap, as described below. In various other implementations, the present invention may be incorporated into flyback transformers or other coupled inductor systems, such as those where current flow through a second inductor does not occur while current flows through a first inductor. Throughout the present disclosure, all references to transformers should be considered equally applicable to these other types of magnetic components, as would be recognized by a person of ordinary skill in the art.

In such an arrangement, the magnetic component allows for near perfect coupling between each one of the primary inductor windings and the second inductor winding. That is, the coupling constant between each one of the primary inductor windings and the second inductor winding is near unity. As a result, all, or a majority of, the magnetic flux generated in the core of one of the primary inductor windings is coupled to the core of the secondary inductor winding. Additionally, this configured results in near-zero coupling of magnetic flux between each of the primary inductor windings with one another. These characteristics allow for efficient operation of the present magnetic component.

Figure 1:
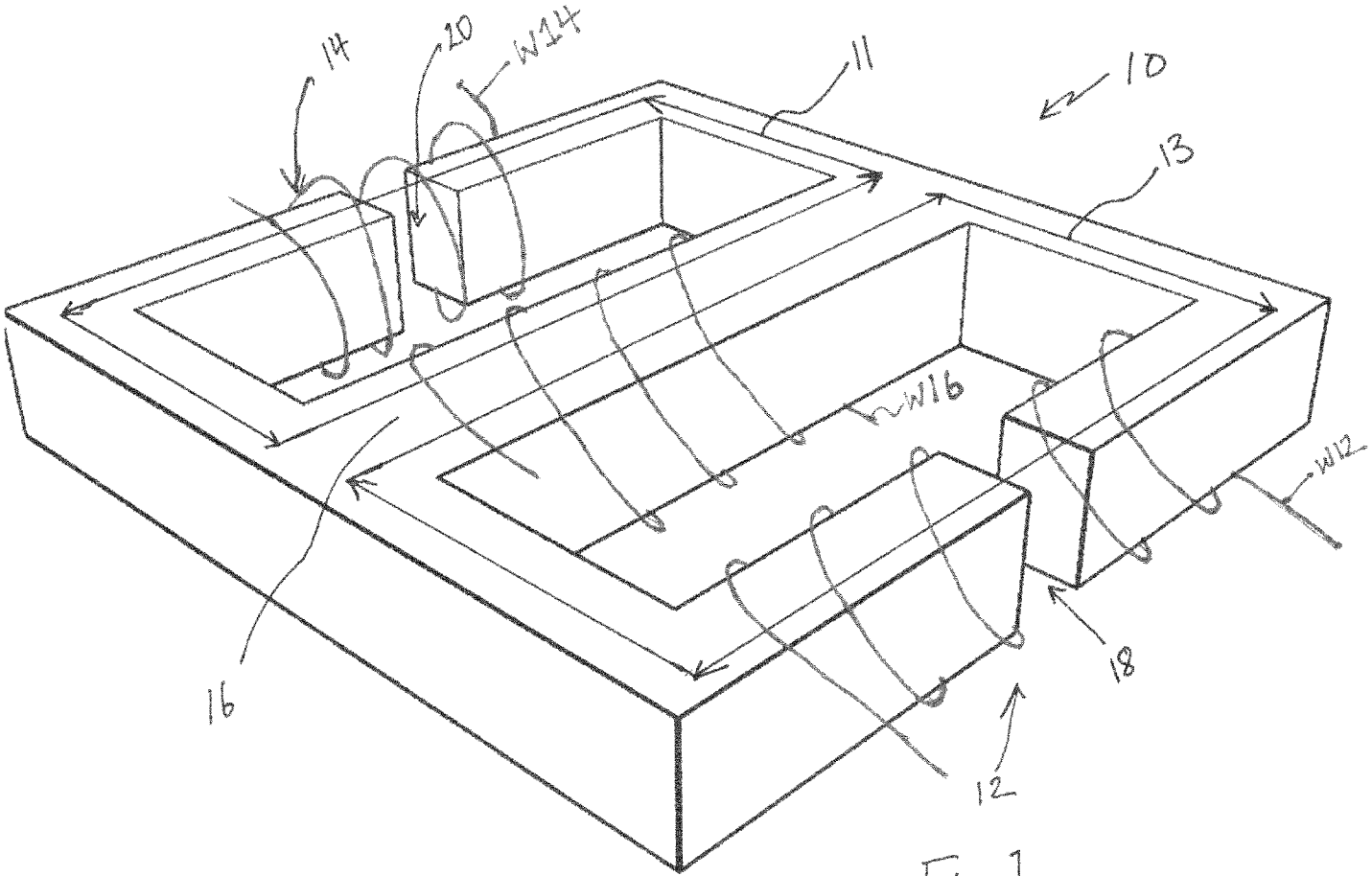
FIG. 1 is an illustration of an example core design for use within the present magnetic component or transformer.

FIG. 1 is an illustration of an example core 10 for use within the present magnetic component or transformer. Core 10 includes three core posts 12, 14 and 16 configured to receive two primary inductor windings at core posts 12 and 14, and a single secondary inductor winding at core post 16. The two primary inductors or windings of the transformer are wound around the two outer core posts 12 and 14. The secondary inductor winding is wound about central core post 16.

As shown in FIG. 1, each of core posts 12 and 14 include air gaps 18 and 20, respectively, while core post 16 does not. To construct core 10, two E-shaped core sections are joined to one another. In that case, the two E-shaped sections are sized so that when joined together, equal air-gaps are formed in the outer legs of the core structure. In one implementation of core 10, the dimension of core posts 12 and 14 are approximately the same, while the area of the cross-section of center post 16 is approximately twice the area of the cross-section of either of posts 12 or 14. The actual dimensions of core posts 12, 14, and 16 can be determined by many factors, which include the electrical characteristics of the input power source, the frequency of operation of the circuit, the value chosen for the input capacitors, and the magnetic material used for making the core. The size of the air-gaps 18 and 20 may also be determined by a number of factors such as the input power source electrical characteristics, the frequency of operation of the circuit, the primary capacitor value, the value of the inductance required, and magnetic materials making up core 10.

To use core 10 within a transformer, windings are formed around each of core posts 12, 14, and 16. Two separate primary windings (illustrated by example windings W12 and W14) are formed around core posts 12 and 14. A secondary winding (see, for example, winding W16) is formed around core post 16. Each of the windings may have any suitable construction. If constructed using wires or litz-wire, bobbin or bobbins with three legs may be used to wind the respective windings onto any of the three core posts. In that case, the bobbins, which are typically made from a plastic or other dielectric material, have three holes into which the core pieces can be inserted. If the windings are formed as z-folded windings, the windings are folded first and then the core pieces are inserted in the central holes within the windings. Barrel-wound windings can also use bobbins. The windings may be formed to lay over either of gaps 18 and 20, either partially or completely coving the air-gap, or may be formed to lay over only the solid portions of core posts 12 and 14.

With the windings formed around each of core posts 12, 14, and 16, each of the primary windings (formed around core posts 12 and 14) can be driven by different excitation currents to generate magnetic flux that is communicated to the secondary winding through core post 16. In FIG. 1 example fluxes are indicated by arrows 11 and 13.

As illustrated in FIG. 1, the cross-sectional area of the central core post 16 is greater than the cross-sectional area of both core posts 12 and 14. In one implementation, the ratio of cross-sectional area between the outer core posts and the inner core post is approximately 1:2. By sizing core posts 12, 14, and 16 in this manner, fluxes produced by the currents in the primary windings (e.g., in core posts 12 and 14) both pass through the central core post 16. Due to the introduction of air gaps 18 and 20 into core posts 12 and 14, respectively, and the fact that central core post 16 is sized for extremely low reluctance, there will be nearly zero coupling between the two primary inductors windings around core posts 12 and 14. Additionally, there will be very good coupling between each primary inductor winding (wound about core posts 12 and 14) with the secondary inductor winding (wound about core post 16).

To ease the construction of the transformer or the magnetic component, the air-gap formed in the outer posts can be filled with any dielectric material, which has a relative magnetic permeability of 1. In other words, the magnetic properties of the material within air-gap should correspond to air or vacuum. Examples of such material include most of the plastics, a resin, and paper.

In general, core posts 12, 14, and 16 may include any soft magnetic materials having high magnetic permeability. These materials include soft ferrites, soft iron and steels, amorphous metals, and nano-magnetic materials. The materials may be selected in order to minimize high frequency core losses.

Figure 2A:
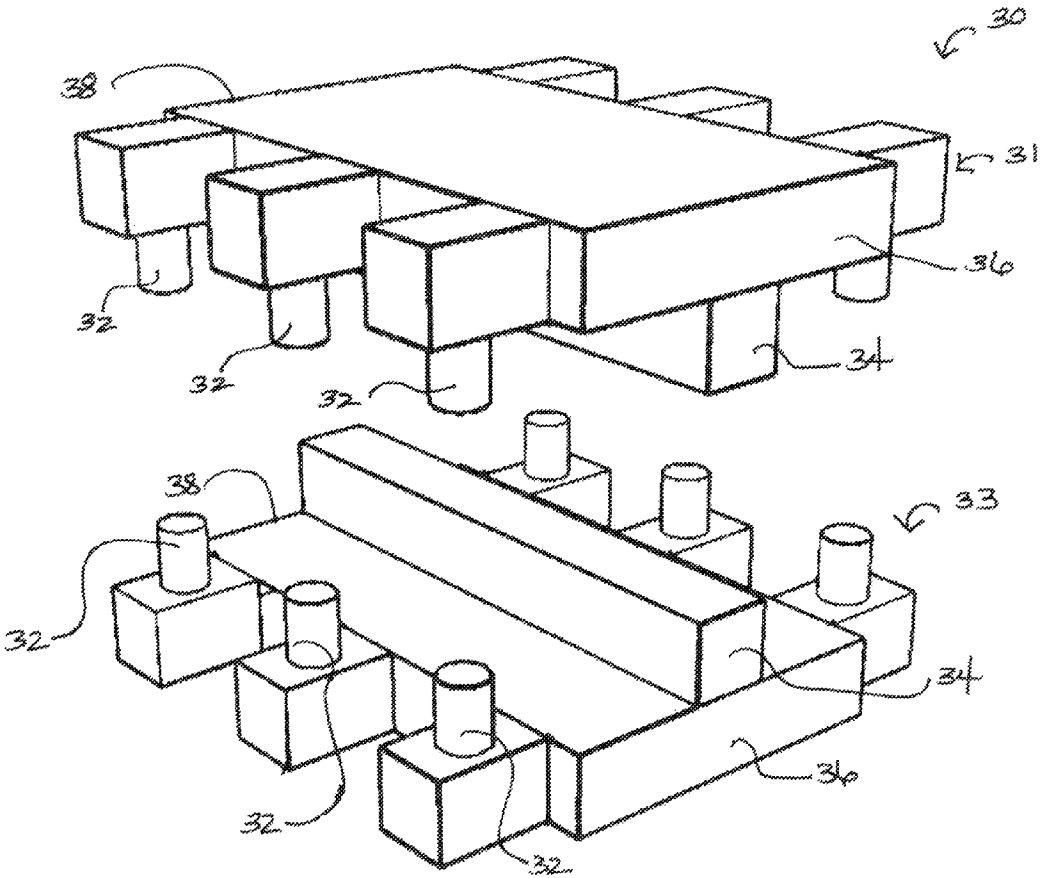
FIGS. 2A and 2B are illustrations of an alternative core design for use within the present magnetic component or transformer having a rectangular geometry.
Figure 2B:
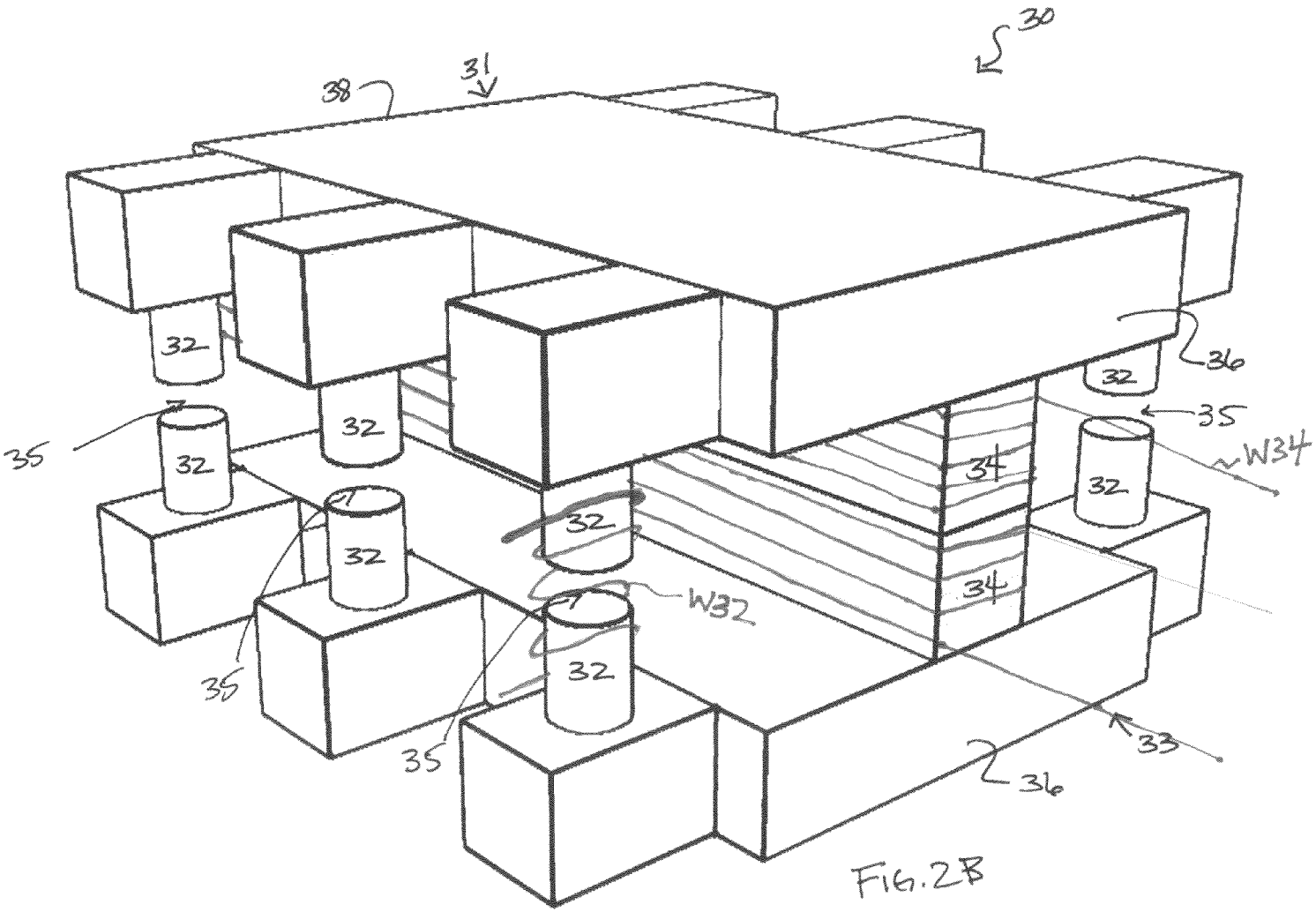

FIGS. 2A and 2B are illustrations of an alternative core 30 for use within the present magnetic component or transformer. FIG. 2A shows core 30 as comprising separate top and bottom sections 31 and 33, respectively. FIG. 2B shows core design 30 after the top and bottom sections 31 and 33 have been joined to one another. The top and bottom sections 31 and 33 may be held together by an adhesive tape, adhesives, glues, mechanical fasteners, or one or more clamp-like devices. The clamp-like device can be made of a metallic material or a hard plastic, for example. Alternatively, the top and bottom section may be held together by the windings formed around each of posts 32 and core structure 34. Core design 30 includes a number of primary core posts 32 configured to receive six separate primary inductor windings. In another implementation, though, a single winding may be wrapped about more than one core post using, for example, a Z-fold winding structure, as discussed below. For example, core 30 may be used with three primary windings, where each winding is wrapped about two core posts. Core design 30 also includes a secondary core structure 34 configured to receive a secondary inductor winding. The primary inductor windings are wound about each of core structures 32, while the secondary inductor winding is wound about core structure 34.

In one implementation, the area of the cross-section of the center (secondary) post 34 is approximately equal to the sum of the areas of the core posts 32, though in other implementation the area of cross section of center post 34 may be larger.

As illustrated in FIG. 2B, core posts 32 are sized so that when top section 31 and bottom section 33 of core design 30 are connected to one another, the top and bottom section of core post 34 mate to one another, while air gap 35 is formed between each of core posts 32. As such, each core post 32 includes an air gap 35, while core post 34 includes no such air gap. The size of the air-gap will be determined, primarily, by the inductance requirement for the primary inductor. The inductance value of the primary inductor will depend upon the power source, frequency of operation, and the resonant frequency.

Because air gaps 35 are formed within each core post 32, and because core post 34 includes no such air gap and is sized for extremely low reluctance, there will be nearly zero coupling between the two primary inductors windings around each of core posts 32 (see example winding W32 formed about one of core posts 32), but there will be very good coupling between the each primary inductor winding (wound about core posts 32) with the secondary inductor winding (wound about core post 34—see, for example, winding W34).

In other implementations, core 30 can be modified to accept any number of primary windings. For example, additional core posts may be positioned at either end of core 30 at, for example, ends 36 or 38 for the addition of windings. Additionally, the overall length of core design 30 may be increased so as to increase the number of windings structures that may be positioned along a length of core design 30. Although core 30 is illustrated as a rectangle, core 30 may be formed in the shape of a square, depending upon the number of primary windings.

Figure 3A:
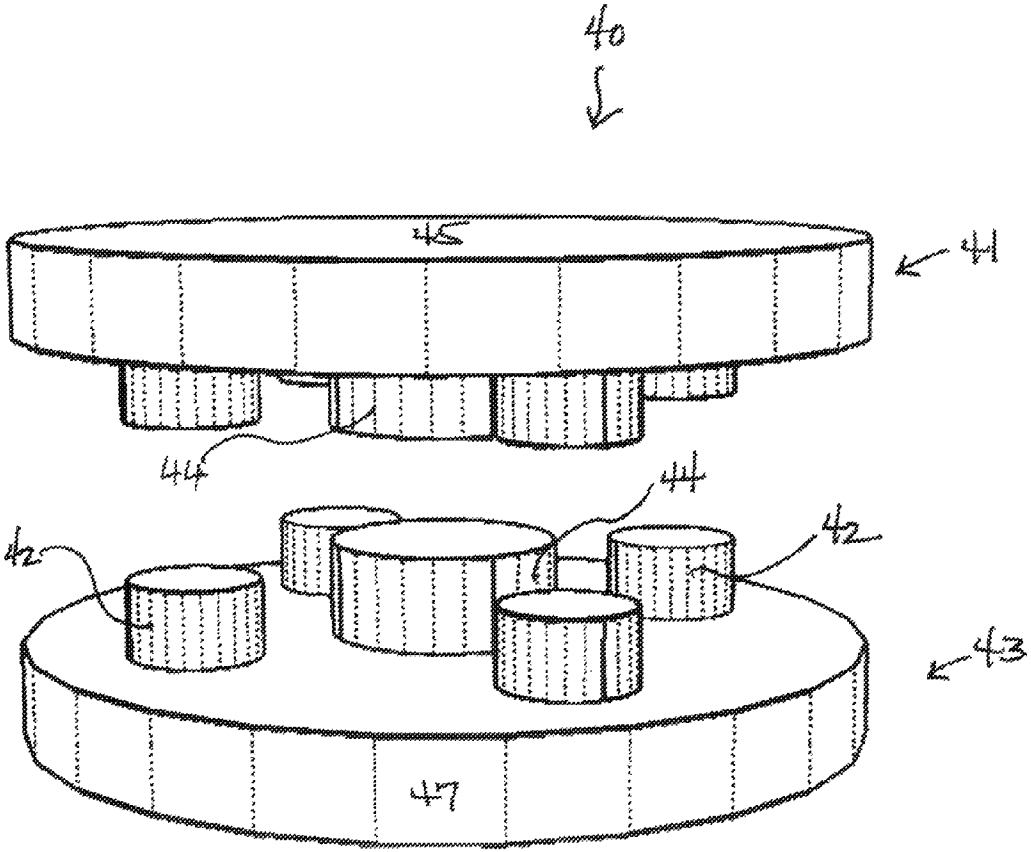
FIGS. 3A and 3B are illustrations of an alternative core design for use within the present magnetic component or transformer having a circular geometry.
Figure 3B:
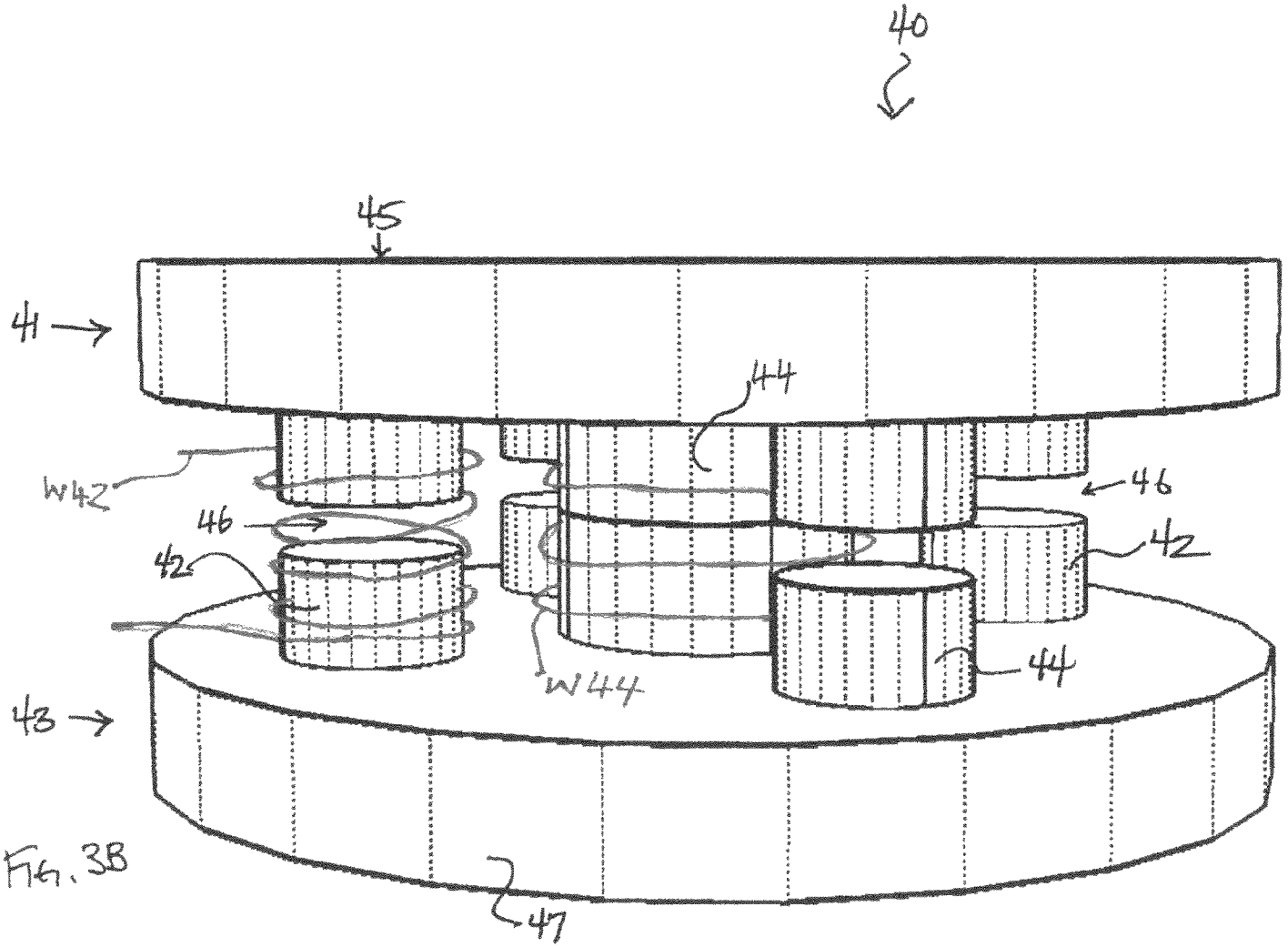

FIGS. 3A and 3B are illustrations of an alternative core design 40 for use within the present magnetic component or transformer. FIG. 3A shows core structure 40 as comprising separate top and bottom sections 41 and 43, respectively. FIG. 3B shows core design 40 after to the top and bottom sections 41 and 43 have been joined to one another. Top and bottom sections 41 and 43 may be held together by an adhesive tape, adhesives, glues, mechanical fasteners, or one or more clamp-like devices. The clamp-like device can be made of a metallic material or a hard plastic, for example. Alternatively, the top and bottom section may be held together by the windings formed around each of posts 42 and core structure 44. As illustrated, top section 41 and bottom section 43 include rounded disks (45 and 47, respectively) to which the components of core design 40 are mounted. In alternative implementations, though, the disks may have different shapes, such as that of ellipses.

Core design 40 includes a number of primary core posts 42 configured to receive four separate primary inductor windings (see example winding W42). Core design 40 also includes a secondary core structure 44 configured to receive a secondary inductor winding (see example winding W44). The primary inductor windings are wound about each of core posts 42, while the secondary inductor winding is wound about core post 44. Although the geometry of both core posts 42 and 44 are shown in FIGS. 3A and 3B as being cylindrical, in other implementations, core posts 42 and/or 44 can have different shapes, such as elliptical cylinders, other generalized cylinders, or cuboids.

As illustrated in FIG. 3B, core posts 42 are sized so that when top section 41 and bottom section 43 of core design 40 are connected to one another, the top and bottom sections of core post 44 mate to one another, while air gap 46 is formed within each of core posts 42. As such, each core post 42 includes an air gap 46, while core post 44 includes no such air gap.

Because air gaps 46 are formed within each core post 42, and because core post 44 includes no such air gap and is sized for extremely low reluctance, there will be nearly zero coupling between the two primary inductors windings around each of core posts 42, but there will be very good coupling between the each primary inductor winding (wound about core posts 42) with the secondary inductor winding (wound about core post 44).

Figure 4:
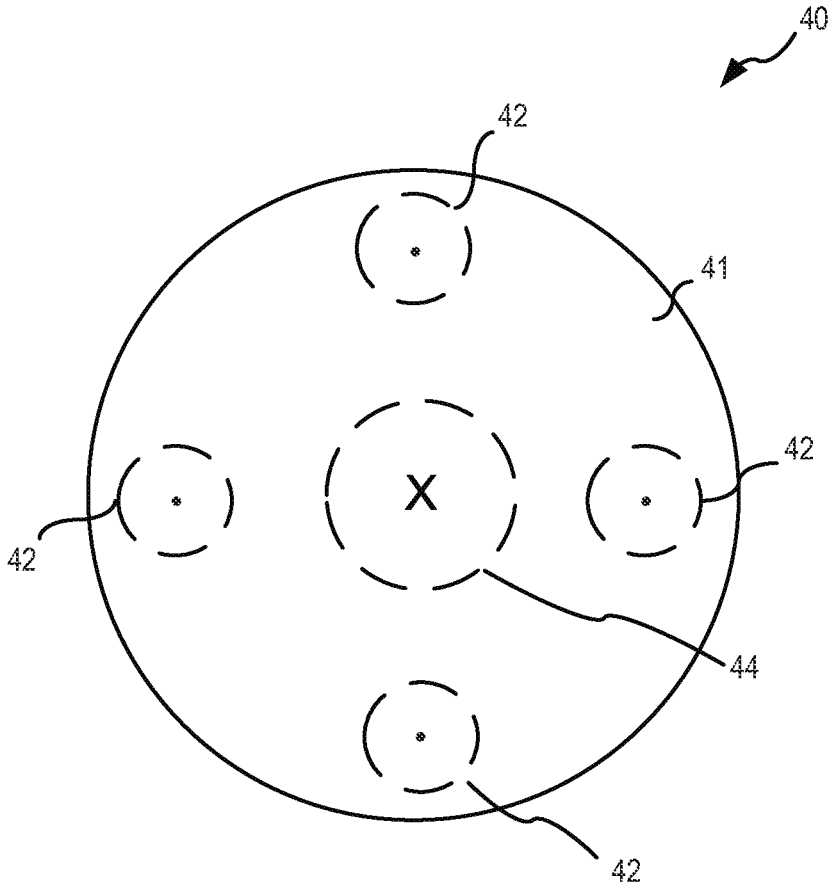
FIG. 4 is an illustration showing a top view of the core design illustrated in FIGS. 3A and 3B showing the direction of flux flow through the structure.

When using core 40 of FIGS. 3A and 3B within a transformer, the windings are formed so that the fluxes of core posts 42 travel in opposite directions. As an illustration, FIG. 4 shows a top view of core 40 illustrates the direction of flux flow through each of core posts 42 and core post 44. In FIG. 4, flux flowing through core posts 42 enters through the top of core 40 (indicated by the dots in the center shown in each core post 42). Flux flowing through core post 44 flows upwards out of core 40, as indicated by the 'X' drawn over post 44.

Figure 5A:
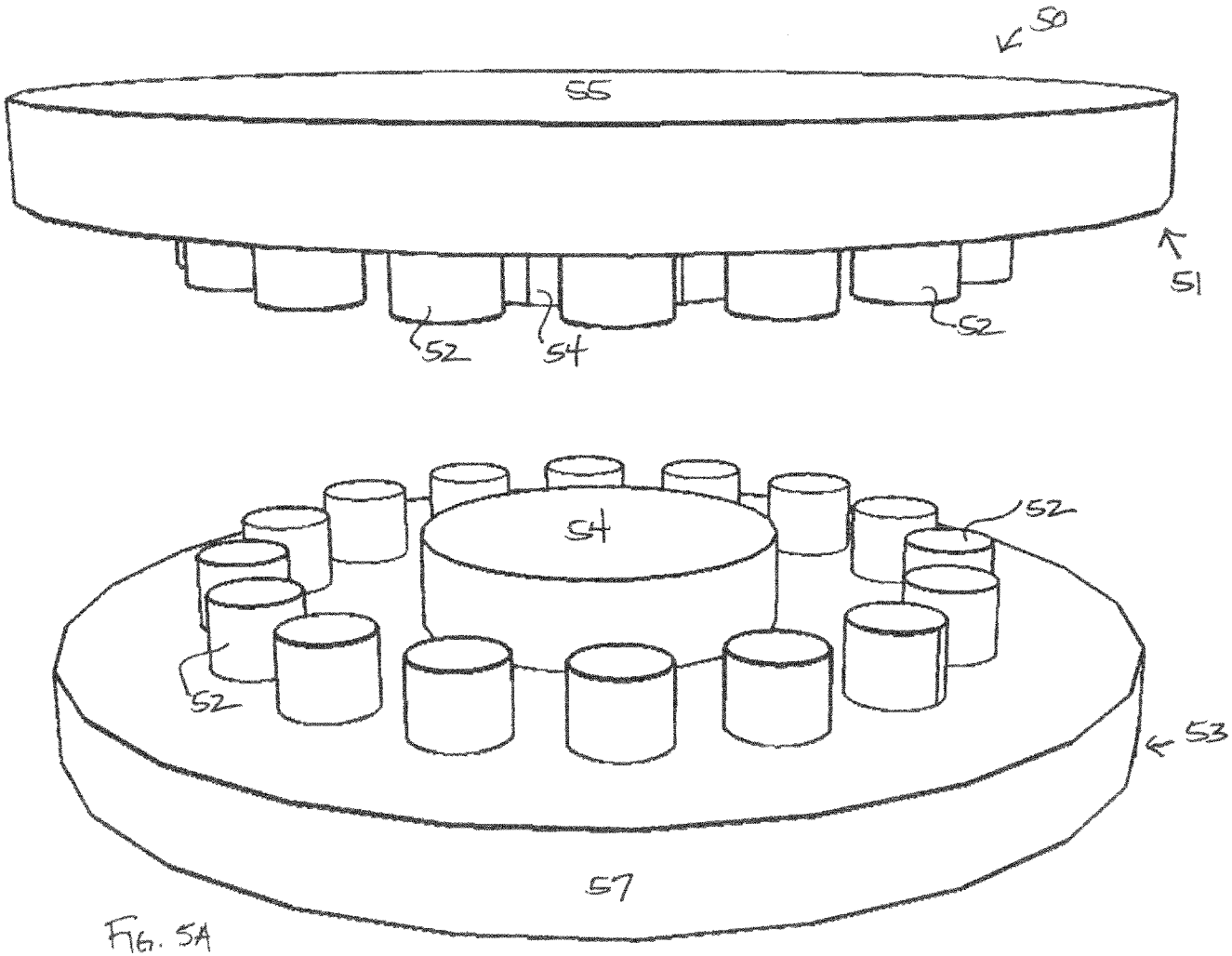
FIGS. 5A and 5B are illustrations of an alternative core design for use within the present magnetic component or transformer.
Figure 5B:
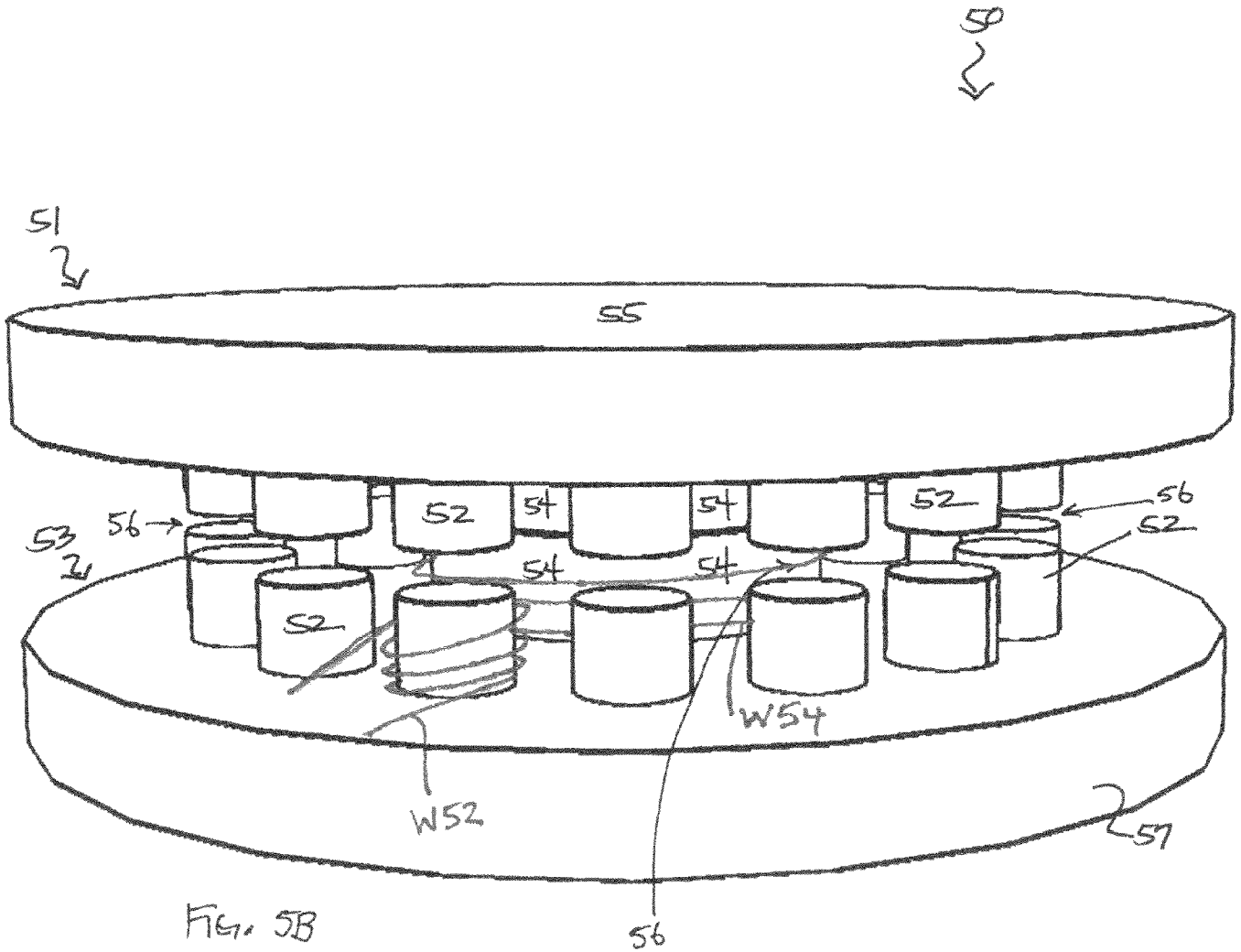

FIGS. 5A and 5B are illustrations of an alternative core 50 for use within the present magnetic component or transformer. FIG. 5A shows core 50 as comprising separate top and bottom sections 51 and 53, respectively. FIG. 5B shows core 50 after to the top and bottom sections 51 and 53 have been joined to one another. As illustrated, top section 51 and bottom section 53 include rounded disks (55 and 57, respectively) over which the components of core 50 are mounted. In an alternative implementation, though, the disks may have different shapes, such as that of ellipses. Core 50 includes a number of primary core posts 52 configured to receive a number of separate primary inductor windings (see example winding W52). Depending upon the system requirements, the number of core posts 52 can be increased by increasing the size of the top and bottom disks 55 and 57 of core 50 and then locating additional core posts 52 thereon. Core 50 also includes a secondary core post 54 configured to receive a secondary inductor winding (see example winding W54). The primary inductor windings are wound about each of core posts 52, while the secondary inductor winding is wound about core post 54. Although the geometry of both core posts 52 and 54 are shown in FIGS. 5A and 5B as being cylindrical, in other implementations, core posts 52 and/or 54 can have different shapes, such as elliptical cylinders, other generalized cylinders, or cuboids.

As illustrated in FIG. 5B, core posts 52 are sized so that when top section 51 and bottom section 53 of core 50 are connected to one another, the top and bottom section of core 54 mate to one another, while air gap 56 is formed between each of core posts 52. As such, each core post 52 includes an air gap 56, while core post 54 includes no such air gap.

Because air gaps 56 are formed within each core post 52, and because core post 54 includes no such air gap and is sized for extremely low reluctance, there will be nearly zero coupling between the two primary inductors windings around each of core posts 52, but there will be very good coupling between the each primary inductor winding (wound about core posts 52) with the secondary inductor winding (wound about core post 54).

Each of the core designs illustrated in FIGS. 1-5B include any soft magnetic materials having high magnetic permeability. These materials include soft ferrites, soft iron and steels, amorphous metals, and nano-magnetic materials. The materials may be selected in order to minimize high frequency core losses.

The magnetic components or transformer device described above can be utilized in a number of electronic circuits. One such circuit includes an electrical circuit configured to extract electrical energy from a power source having a high impedance, as described below.

Additionally, the material and construction types for various primary and secondary windings may include combinations of insulated metallic wire, such as copper or aluminum, high frequency Litz wire, sheet copper with insulating tape, Z-fold flex circuit windings, or barrel wound flex circuit, such as that illustrated in U.S. Pat. No. 5,570,074.

Figure 6:
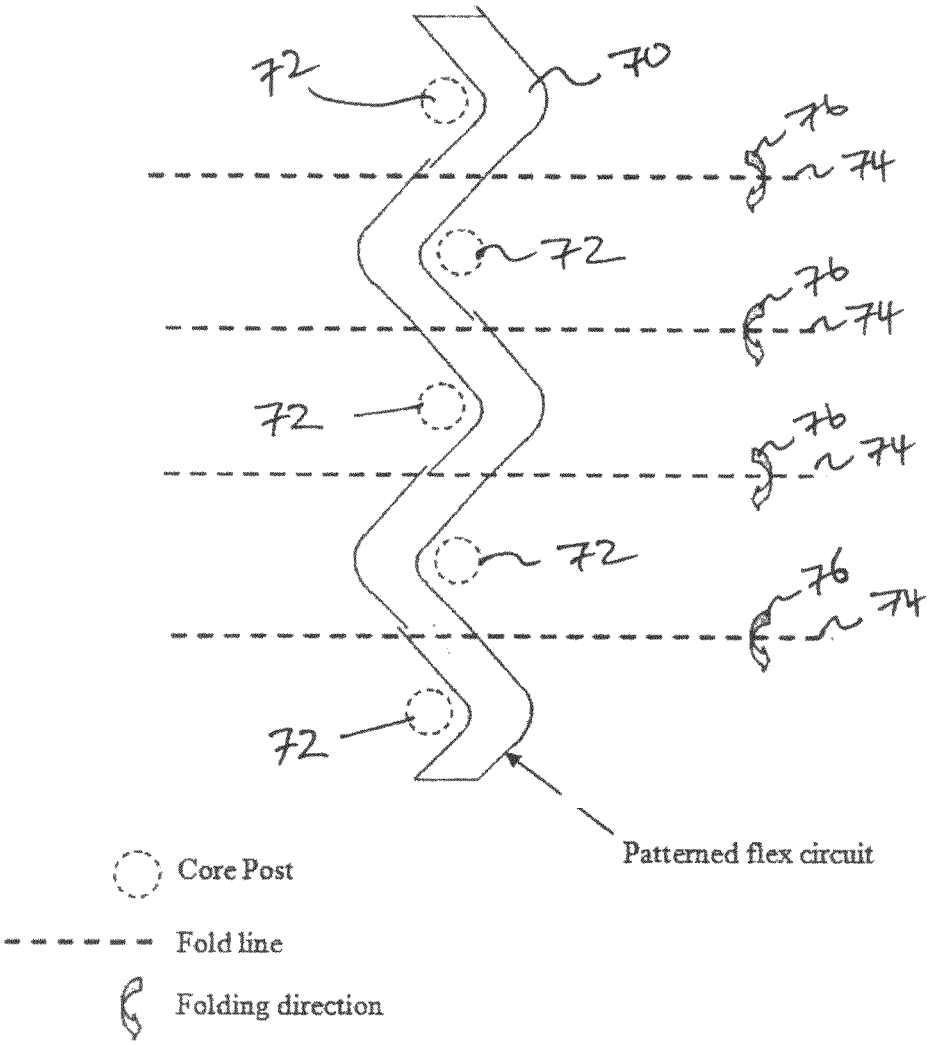
FIG. 6 is an illustration showing an example Z-folded flex circuit structure for use in the present magnetic component.

FIG. 6 is an illustration showing an example Z-folded flex circuit structure for use in the present magnetic component. As illustrated, the winding material 70 is weaved between a number of core posts 72. At certain points within the weave (indicated by dashed lines 74, winding material 70 is folded in a particular direction according to arrows 76. As illustrated, this winding structure is useful when preparing a winding that is formed around a number of core posts 72.

Figure 7:
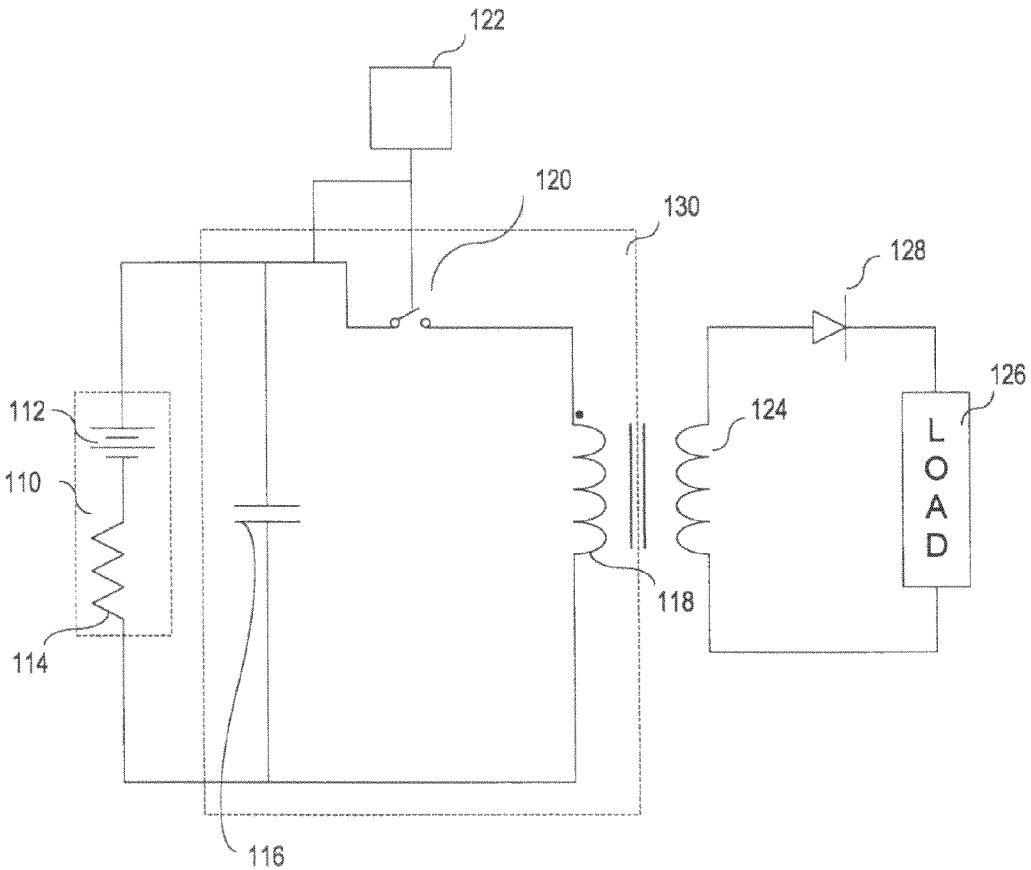
FIG. 7 is an illustration of an electrical circuit including a power source having a relatively high internal resistance and a load, where the circuit incorporates a power extraction circuit configured in accordance with the present disclosure.

FIG. 7 is an illustration of an electrical circuit including a power source having a relatively high internal resistance and a load, the circuit incorporates a power extraction circuit 130 connected between the power source and the load, where the power extraction circuit is configured in accordance with the present disclosure. As shown in FIG. 7, the circuit includes power source 110. Power source 110 includes a voltage source 112 and an internal resistance 114. Power source 110 may include a power source having a relatively high internal resistance 114, such as a solar cell or a fuel cell. A typical solar cell can comprise a power source having an open circuit voltage of 0.6 volts and an internal resistance of approximately 3 ohms. In such a supply, the short circuit current is typically 0.2 amperes.

Capacitor 116 is connected across the terminals of power source 110. Capacitor 116 may be selected to have a low equivalent series resistance (ESR). Inductor 118 is also connected across the terminals of power source 110. Switch 120 is connected between a first terminal of inductor 118 and a first terminal of power source 110. Switch 120 is configured to optionally connect or disconnect the first terminal of inductor 118 to or from the first terminal of power source 110. The open or closed status of switch 120 is controlled by processor 122 that is connected to switch 120. Processor 122 is also configured to monitor energy flow into capacitor 116 from power source 110 and out of capacitor 116 into inductor 118. In one implementation, switch 120 includes a switch having low high-frequency switching losses, capacitance, and low turn-on resistances. Example switches include metal oxide semiconducting field effect transistors (MOSFETs), bi-polar Junction transistors (BJTs), and silicon-controlled rectifiers (SCRs).

In one implementation, energy flow into and out of the capacitor is determined by analyzing the voltage capacitor using, for example, a voltage sensor connected across the capacitor. Energy flow into and out of the capacitor is related to the voltage across the capacitor. This energy flow can be determined by measuring a voltage across the capacitor and then using that voltage measurement to identify an energy transfer rate using, for example the transfer rate curve of FIG. 8.

Inductor 118 is coupled to inductor 124 so that a change in current flow through one inductor induces a voltage across the second inductor. This allows electrical energy to be transferred from inductor 118 to inductor 124. In one implementation, inductors 118 and 124 include inductors having relatively low high-frequency losses and are each wound around the same core to facilitate magnetic coupling. Alternatively, inductors 118 and 124 may each be replaced by the primary and secondary windings of a transformer. For example, inductors 118 and 124 may form the primary and second winding on a transformer comprising a core structure as described above. In one implementation, inductor 118 may be wrapped around core 12 and/or core 14 of core design 10 shown in FIG. 1. In that case, inductor 124 may be wrapped around core 16 of core design 10. In other implementations, the core structures shown in FIGS. 2A, 2B, 3A, 3B, 5A and 5B could be incorporated into a transformer where inductor 118 operates as the transformer's primary winding and inductor 124 operates as the transformers secondary winding.

Inductor 124 is connected across load 126 in order to deliver electrical energy thereto. Diode 128 (e.g., a diode having a low forward voltage drop) is disposed between a first terminal of inductor 124 and load 126 to limit current flow between inductor 124 and load 126 to a single direction. In one implementation, an output capacitor (not shown) may be coupled across load 126, wherein the output capacitor is selected to meet the required output ripple voltage requirement.

The combination of capacitor 116, switch 120, and inductor 118 form power extraction circuit 130 of the present invention.

During operation of the circuit shown in FIG. 1, capacitor 116 initially draws current from power source 110 (for example, when power source 110 is first connected to capacitor 116). As the voltage of capacitor 116 increases, an amount of current (and, thereby, energy) flowing from power source 110 to capacitor 116 begins to decrease (see, for example, FIG. 8, described below). Because the current flow to capacitor 116 is varied (and, consequently, the voltage of capacitor 116 is varied), the rate at which energy is transferred from power source 110 to capacitor 116 is not constant. Instead, the rate of energy transfer varies with time. This variation in energy transfer is illustrated in FIG. 8.

Figure 8:
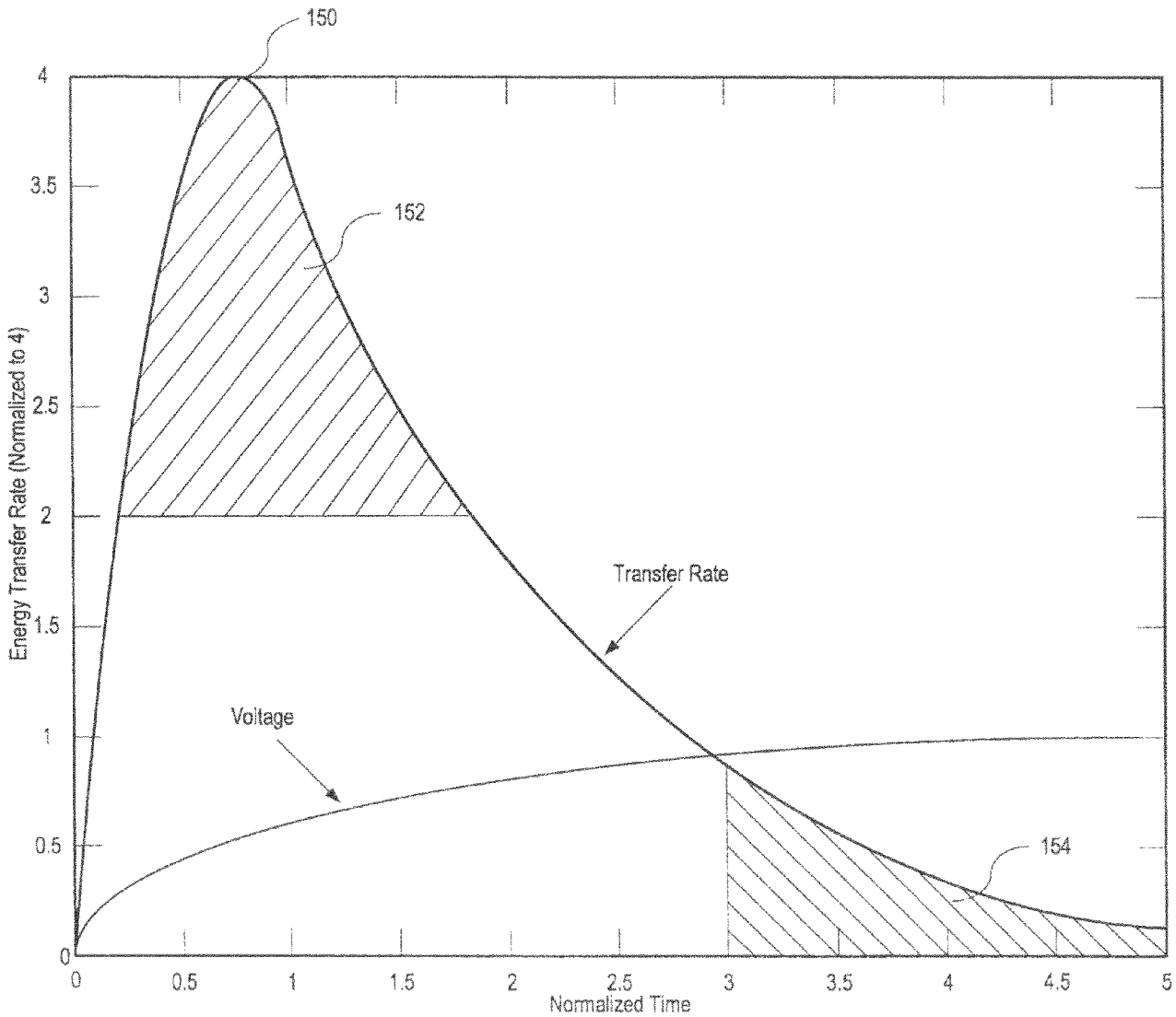
FIG. 8 is a graph showing an energy transfer rate from a power source to a capacitor as well as the corresponding voltage across the capacitor versus time.

FIG. 8 is a graph showing energy transfer rate from power source 110 to capacitor 116 as well as the corresponding voltage across capacitor 116 versus time. As seen in FIG. 8, initially, the energy transfer to the capacitor is relatively high (see, for example, point 150 of the transfer curve). As such, there is a period of time after power source 110 initially begins transferring energy to capacitor 116 in which energy is transferred most efficiently. This period of time is illustrated by shaded region 152 of FIG. 8.

As time passes, however, the energy transfer to capacitor 116 become less and less efficient. Referring to FIG. 8, for example, after the initial period of efficient energy transfer, the energy transfer efficiency diminishes relatively rapidly. As the voltage of capacitor 116 approaches that of power source 110 minus the voltage drop across power source 110's internal resistance, energy transfer is very inefficient. This period of inefficient transfer is illustrated by shaded area 154 on FIG. 8.

To ensure that energy is being transferred efficiently to capacitor 116 (and, therefore, out of power source 110), the present system is configured to ensure that capacitor 116 and power source 110 are operating so that the energy transfer characteristics fall within shaded area 152 of FIG. 8. To accomplish this, switch 120 is periodically closed to move energy out of capacitor 116 into inductor 118 and, from there, into load 126. By periodically discharging capacitor 116 into inductor 118, the voltage across capacitor 116 can be maintained below a threshold value allowing for energy to be efficiently transferred out of power source 110, even when power source 110 has a high internal resistance.

To provide for efficient transfer of energy out of power source 110 (and into capacitor 116), processor 122 is configured to implement the method illustrated in FIG. 9. In step 160, processor 122 monitors energy delivery from power source 110 to capacitor 116. In step 162, processor 122 compares the measured energy flow to a predetermined threshold in step 162. When the energy flow into capacitor 116 from power source 110 falls above the predetermined threshold (e.g., within shaded region 152 (shown in FIG. 8)), processor 122 causes switch 120 to be open allowing energy to continue to flow from power source 110 to capacitor 116 in step 164.

In a typical installation (e.g., using a solar cell), optimal energy transfer occurs when the capacitor voltage is between 20% and 75% of the open circuit voltage of the solar cell (or other high internal resistance power source). In other words, for a typical solar cell with an open circuit voltage of 0.6 volts and an internal resistance of 3 ohms, the capacitor voltage for which the switch will remain open is between 0.12 volts and 0.45 volts. For all other values of capacitor voltage the switch will be closed. This condition allows for efficient energy transfer from power source 110 directly to capacitor 116.

As capacitor 116 charges, however, the energy transfer from power source 110 becomes less efficient (see, for example, FIG. 8). If processor 122 detects that the energy transfer rate from power source 110 to capacitor 116 falls below the threshold (e.g., outside of shaded region 152 shown in FIG. 8), processor 122 causes switch 120 to close in step 166. The various thresholds at which switch 120 opens and closes will be adjusted based upon the characteristics of power source 110. With switch 120 closed, capacitor 116 is connected to inductor 118. Capacitor 116 will then resonate with inductor 118 causing energy to be transferred from capacitor 116 to inductor 118, where it is eventually transferred through inductor 124 into load 126.

After closing switch 120, processor 122 monitors the amount of energy remaining within capacitor 116 in step 168 and compares that amount of energy to a threshold value. As the voltage across capacitor 116 is directly related to the energy stored therein, the remaining energy of capacitor 116 may be determined by detecting and monitoring a voltage across capacitor 116. Until sufficient energy has been transferred out of capacitor 116, processor 122 holds switch 120 in a closed condition. After sufficient energy has been dissipated from capacitor 116 through switch 120 and into inductor 118 so that power source 110 may again efficiently transfer energy into capacitor 116, processor 122 opens switch 120 in step 170. The method is shown in FIG. 9 then repeats with processor 122 continually monitoring energy transfer from power source 110 to capacitor 116.

With switch 120 open, capacitor 116 begins the next cycle of energy transfer from power source 110 to the capacitor 116 and, eventually, to inductor 118. In one implementation, the period of time in which switch 120 is closed is typically smaller than the period of time that switch 120 is open. This results because the circuit is operating in a mode in which most of the time maximum power is transferred to capacitor 116.

In one specific implementation of the electrical circuit illustrated in FIG. 7, power source 110 includes a solar cell having an open circuit voltage of 0.6 volts, an internal resistance of 3 ohms, and a short-circuit current of 0.2 amperes. In conjunction with such a power source, capacitor 116 may be selected to have a capacitor of approximately 5 micro-Farads. The frequency of sampling the capacitor will depend on the time constant of the circuit, which is given by the product of capacitance value and the internal resistance of the solar cell or panel. In one implementation, the time period between samples is approximately 50-100 times shorter than that time constant.

The present system differs greatly from conventional power supply circuits that incorporate input capacitors. In those circuits, the input capacitor is selected to be as large as possible in order to provide a constant voltage to the remaining circuit. In other words, the input capacitor operates as a buffer to compensate for temporary disruptions in power consumption of the connected load. In contrast, in the present system, a relatively small capacitor is used because the capacitor does not operate as an input capacitor and is instead used to only extract energy from the high internal resistance power source. Additionally, the capacitor should be capable of resonating with the inductor to quickly transfer accumulated energy to the circuit's load. If a large, conventional input capacitor were to be used in conjunction with the present system, the rate of transfer of energy to the capacitor (e.g., capacitor 116 of FIG. 7) would be diminished, as indicated by shaded area 154 of FIG. 8.

In some implementations of the present system, a number of power sources, each having relatively high internal resistances, are connected together in series to serve a particular load. In conventional systems, this would ordinarily result in poor performance as any current flowing from one power source must pass through the high internal resistance of the other power sources that are each connected together. The present system, in contrast, allows for current drawn from each power source to flow to an inductor supplying the load without also flowing through the internal resistances of the other power sources.

Figure 10:
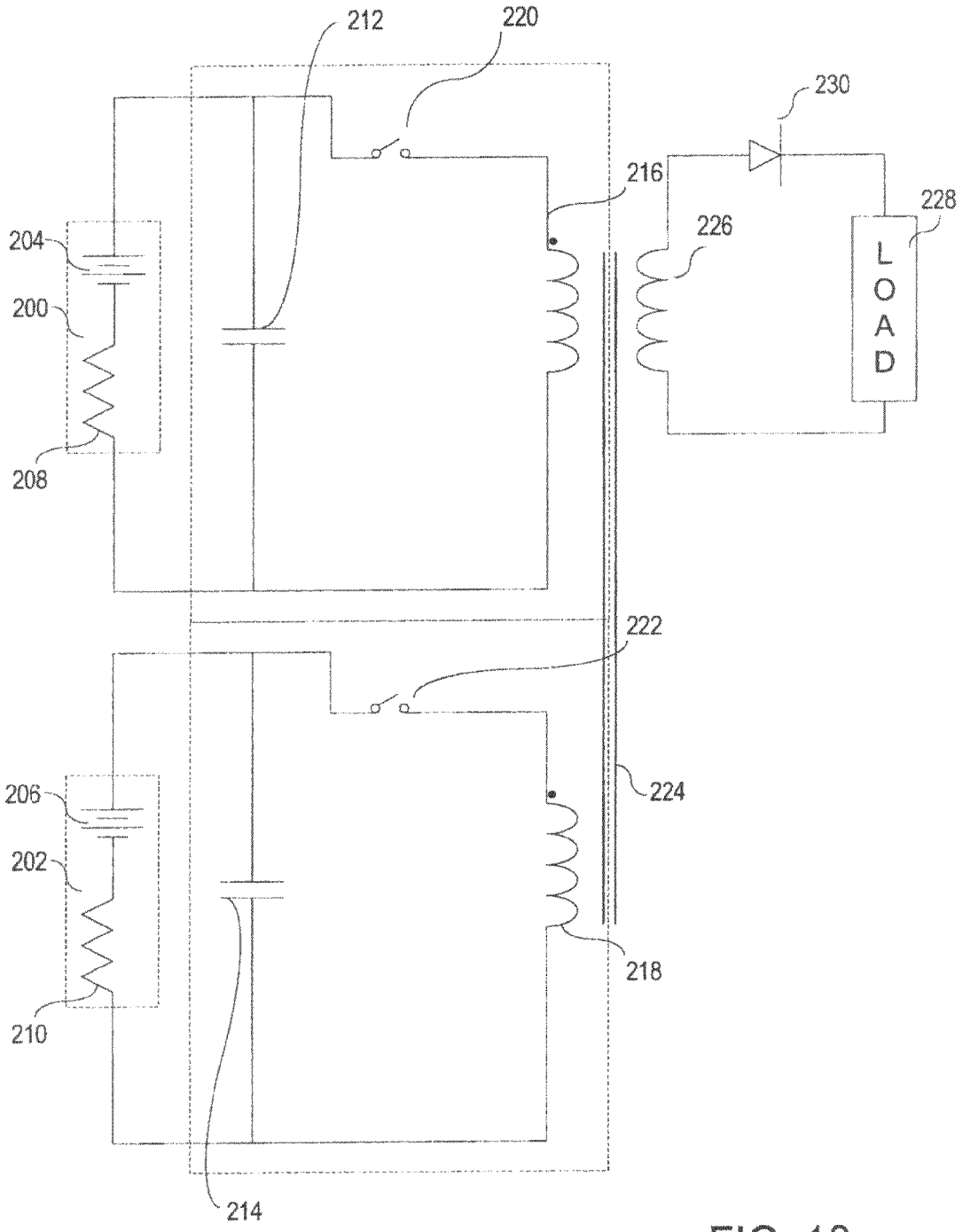
FIG. 10 is an illustration of an electrical circuit including two power sources connected in series and connected to power extraction circuitry.
Figure 11A:
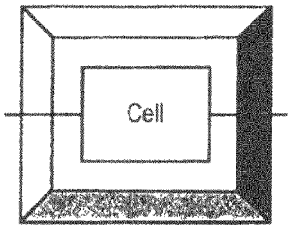
FIGS. 11A-11D illustrate a number of potential interconnections between solar cells within a device.
Figure 11B:
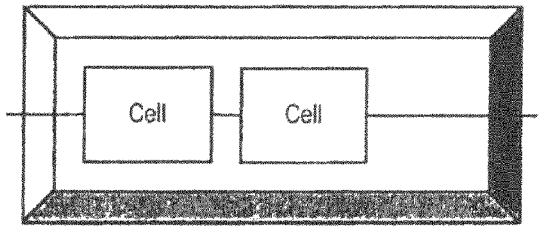
Figure 11C:
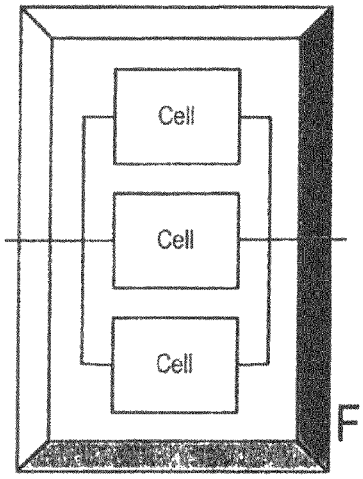
Figure 11D:
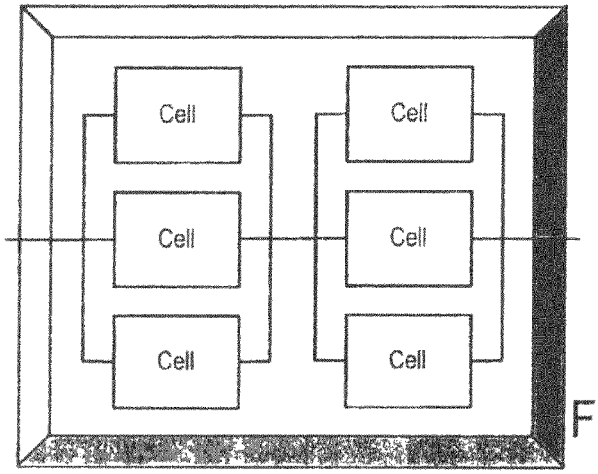

FIG. 10 is an illustration of an electrical circuit including two power sources, each having a relatively high internal resistance, connected in series to a load, wherein the circuit incorporates power extraction circuitry connected to each power source. As shown in FIG. 10, the circuit comprises two power sources 200 and 202. Each power source includes a voltage supply 204 and 206 and a relatively high internal resistance 208 and 210. Capacitor 212 is connected across the terminals of power source 200. Capacitor 214 is connected across the terminals of power source 202. Inductor 216 is connected across the terminals of power source 200 via switch 220. Inductor 218 is connected across the terminals of power source 200 via switch 222. Switch 220 is connected between a first terminal of inductor 216 and a first terminal of power source 200. Switch 222 is connected between a first terminal of inductor 218 and a first terminal of power source 202. Each of switches 220 and 222 are configured to optionally connect or disconnect the first terminal of inductors 216 and 218 to their respective power sources. The open or closed status of switches 220 and 222 are controlled by one or more connected processors (not shown).

In one implementation of the circuit shown in FIG. 10, the capacitances of capacitors 212 and 214 are approximately equal, while the inductances of inductors 216 and 218 are also approximately equal. In that case, with the components connected to each power source being matched, both switches 220 and 222 may be operated synchronously, with each of the switches being opened and closed at the same in accordance with the method illustrated in FIG. 9.

Each of inductors 216 and 218 are wound about core 224 and are, thereby, coupled to inductor 226. Because each of inductors 216 and 218 are wound about the same core, their flux is additive, causing inductor 226 to see a summed voltage for each inductor. In one implementation, inductors 216 and 218 and inductor 226 form the primary and secondary windings, respectively, in a transformer that incorporates a core structure as described above. In one implementation, inductors 216 and 218 may be wrapped around cores 12 and 14, respectively of core design 10 shown in FIG. 7 to form the primary windings for the transformer. In that case, inductor 226 may be wrapped around core 16 of core design 10 to form the secondary winding of the transformer. In other implementations, the core structures shown in FIGS. 2A, 2B, 3A, 3B, 5A and 5B could be incorporated into a transformer by replacing core 224 of the circuit illustrated in FIG. 10.

Through core 224, inductors 216 and 218 transfer energy to inductor 226 which is, in turn, connected across load 228. Diode 230 is disposed between a first terminal of inductor 226 and load 228 to limit current flow between inductor 226 and load 228 to a single direction. In one implementation, an output capacitor may be coupled across load 228, wherein the output capacitor is selected to meet the required output ripple voltage requirement.

Although the circuit of FIG. 9 shows only two series-connected power sources, more power sources may be connected in series.

FIG. 10, therefore, shows two separate power sources 200 and 202, each independently configured in accordance with the single power source of FIG. 7.

Accordingly, each power source is connected to a power extraction circuit to improve the efficiency of energy transfer from each power source to the target load. Each power extraction circuit in FIG. 10 includes a switch (e.g., switches 220 and 222) that can be periodically opened and closed to transmit energy from the power source to the attached capacitor (e.g., one of capacitors 212 and 214) in accordance with the method shown in FIG. 9.

In one implementation, the present system may be used to facilitate the retrieval of energy from one or more solar cells. Solar cells can be connected in series or in parallel or a combination of series and parallel connections. In any configuration, the power extraction circuit of the present system can be coupled to each solar cell to facilitate energy extraction therefrom. FIGS. 11A-11D illustrate a number of potential interconnections between solar cells within a device. In other implementations, though, the present system may be used to facilitate energy retrieval from any power source having a high internal resistance such as a solar cell or fuel cell.

While the preferred embodiments of the present invention have been illustrated in detail, it should be apparent that modifications and adaptations to those embodiments may occur to one skilled in the art without departing from the scope of the present invention as set forth in the following claims.

We claim:

1. A magnetic component, comprising:

a core, including:

a first plate, a second plate, a secondary core post connected between the first plate and the second plate, a plurality of primary core posts disposed between the first plate and the second plate, each of the plurality of primary core posts including a first section connected to the first plate and a second section connected to the second plate, the first and second section of each of the plurality of primary core posts being separated by a gap;

a secondary winding formed about the secondary core post; and primary windings formed about each of the plurality of primary core posts;

wherein:

the secondary core post is not formed to include an air gap therethrough; and a cross sectional area of the secondary core post is about equal to the sum of the cross-sectional areas of the plurality of primary core posts.

2. The magnetic component of claim 1, wherein the core comprises a material selected from the list consisting of ferrite, soft iron, steel, amorphous metal, and nano-magnetic materials.

3. The magnetic component of claim 1, wherein at least one of the primary windings is configured to couple to a power source having a high internal impedance.

4. The magnetic component of claim 3, wherein the power source comprises a solar cell.

5. The magnetic component of claim 4, wherein the solar cell has an open circuit voltage of approximately 0.5 volts to approximately 0.65 volts and an internal resistance of approximately 3 ohms.

6. The magnetic component of claim 1, wherein at least one of the plurality of primary windings and the second winding include a high-frequency Litz wire.

7. The magnetic component of claim 1, wherein at least one of the plurality of primary windings and the second winding include a Z-folded flex circuit winding.

8. The magnetic component of claim 1, wherein the magnetic component includes a transformer, a flyback transformer, or coupled inductors.

9. A magnetic component core, comprising:

a first plate, a second plate, a secondary core post connected between the first plate and the second plate, and a plurality of primary core posts disposed between the first plate and the second plate, each of the plurality of primary core posts including a first section connected to the first plate a second section connected to the second plate, the first and second section of each of the plurality of primary core posts being separated by a gap;

wherein:

the secondary core post is not formed to include an air gap therethrough; and a cross sectional area of the secondary core post is about equal to the sum of the cross-sectional areas of the plurality of primary core posts.

10. The magnetic component core of claim 9, wherein the first plate and the second plate comprise a material selected from the list consisting of ferrite, soft iron, steel, amorphous metal, and nano-magnetic materials.

11. The magnetic component core of claim 9, wherein the gap comprises a dielectric material.

12. The magnetic component core of claim 11, wherein the dielectric material has a relative magnetic permeability of approximately 1.

13. A method of manufacturing a magnetic component, comprising:

forming a first plate of a magnetic component core, the first plate including a first primary core post and a first secondary core post formed over a surface of the first plate, a height of the first primary core post above the surface of the first plate being less than a height of the first secondary core post above the surface of the first plate;

forming a second plate of the magnetic component core, the second plate including a second primary core post and a second secondary core post formed over a surface of the second plate, a height of the second primary core post above the surface of the second plate being less than a height of the second secondary core post above the surface of the second plate; and connecting the first and second plate of the magnetic component core by joining the first secondary core post to the second secondary core post;

wherein:

after said connecting, a distal end of the first secondary core post contacts a distal end of the second secondary core post such that the connected first secondary core post and second secondary core post does not include an air gap therein.

14. The method of claim 13, including forming a winding around the first and second secondary core posts.

15. The method of claim 13, including forming a winding around the first and second primary core post.

16. The method of claim 15, wherein the winding is configured to couple to a power source having a high internal impedance.

17. The method of claim 13, wherein, when the first of the magnetic component core is connected to the second plate of the magnetic component core a gap is disposed between the first primary core post and the second primary core post.

18. The method of claim 17, including disposing a dielectric material into the gap.

19. The method of claim 18, wherein the dielectric material has a relative magnetic permeability of approximately 1.

20. The method of claim 13, wherein at least one of the first and second plate of the magnetic component core comprises a material selected from the list consisting of ferrite, soft iron, steel, amorphous metal, and nano-magnetic materials.

* * * * *